United States Patent [19]

Reiniche et al.

[11] 4,150,706

[45] Apr. 24, 1979

[54] PROCESS FOR THE MANUFACTURE OF UNDULATED METALLIC ELEMENTS FOR THE REINFORCEMENT OF COMPOSITE MATERIALS

[75] Inventors: André Reiniche, Clermont-Ferrand; Philippe Sauvage, Chateaugay, both of France

[73] Assignee: Compagnie Generale des Etablissements Michelin, Clermont-Ferrand, France

[21] Appl. No.: 910,962

[22] Filed: May 30, 1978

[30] Foreign Application Priority Data

Jun. 6, 1977 [FR] France ..... 77 17482

[51] Int. Cl.[2] ..... B22D 11/06

[52] U.S. Cl. ..... 164/49; 164/87; 164/423

[58] Field of Search ..... 164/82, 87, 89, 423, 164/427, 49, 147; 264/164, 168, 176 F, 177 F, 178 F

[56] References Cited

U.S. PATENT DOCUMENTS

| | | | |
|---|---|---|---|
| 2,090,669 | 8/1937 | Dreyfus et al. | 264/168 |
| 2,326,174 | 6/1943 | Rutishauser | 264/168 |

*Primary Examiner*—Othell M. Simpson
*Assistant Examiner*—K. Y. Lin
*Attorney, Agent, or Firm*—Brumbaugh, Graves, Donohue & Raymond

[57] ABSTRACT

A process for the manufacture of filiform reinforcement elements of steel in the form of ribbons is improved by projecting a jet of liquid steel onto a cylinder rotating in a cooling medium and imparting a relative reciprocating movement parallel to the axis of rotation of the cylinder between the jet of liquid steel and the cylinder in order to undulate the ribbon in the direction parallel to the axis of rotation of the cylinder.

6 Claims, 4 Drawing Figures

PROCESS FOR THE MANUFACTURE OF UNDULATED METALLIC ELEMENTS FOR THE REINFORCEMENT OF COMPOSITE MATERIALS

The present invention relates to improvements in a process for the manufacture of filiform reinforcement elements for composite materials.

By providing such elements or ribbons having a nearly rectangular or planoconvex cross-section with undulations perpendicular to their longitudinal axis and parallel preferably to the largest dimension of their cross-section, one considerably improves the adherence or anchoring force between the composite material or agglomerate to be reinforced and the reinforcement elements.

The object of the present invention is a process for the manufacture of such elements having the form of transversely undulated ribbons using an installation for the manufacture of metal wire which projects a jet of liquid metal into a cooling medium, said metal being preferably steel of high silicon content. One such installation is described in U.S. Pat. Nos. 3,861,452 and 3,896,870.

It is already known to manufacture ribbons of nearly rectangular cross-section by projecting a jet of liquid metal by means of such an installation onto a cylinder rotating around an axis of invariable position and located in the cooling medium.

Upon flattening out on the cylinder, the jet solidifies so as to form a wire or rather a ribbon of nearly rectangular cross-section or flat on one face and slightly convex on the other face.

The invention consists in imparting a relative movement between the liquid jet or the terminal portion of the liquid jet and the cylinder, said relative movement being reciprocating and parallel to the axis of rotation of the cylinder.

This relative movement may be obtained in two ways. In accordance with a first variant, a reciprocating movement is imparted to the cylinder parallel to its axis of rotation.

In accordance with a second variant, a reciprocating movement is imparted to the jet or the terminal portion of the jet parallel to the axis of rotation of the cylinder.

The figures of the accompanying schematic drawing and the portion of the present specification which refers thereto illustrate several embodiments of the invention.

Figure 1:
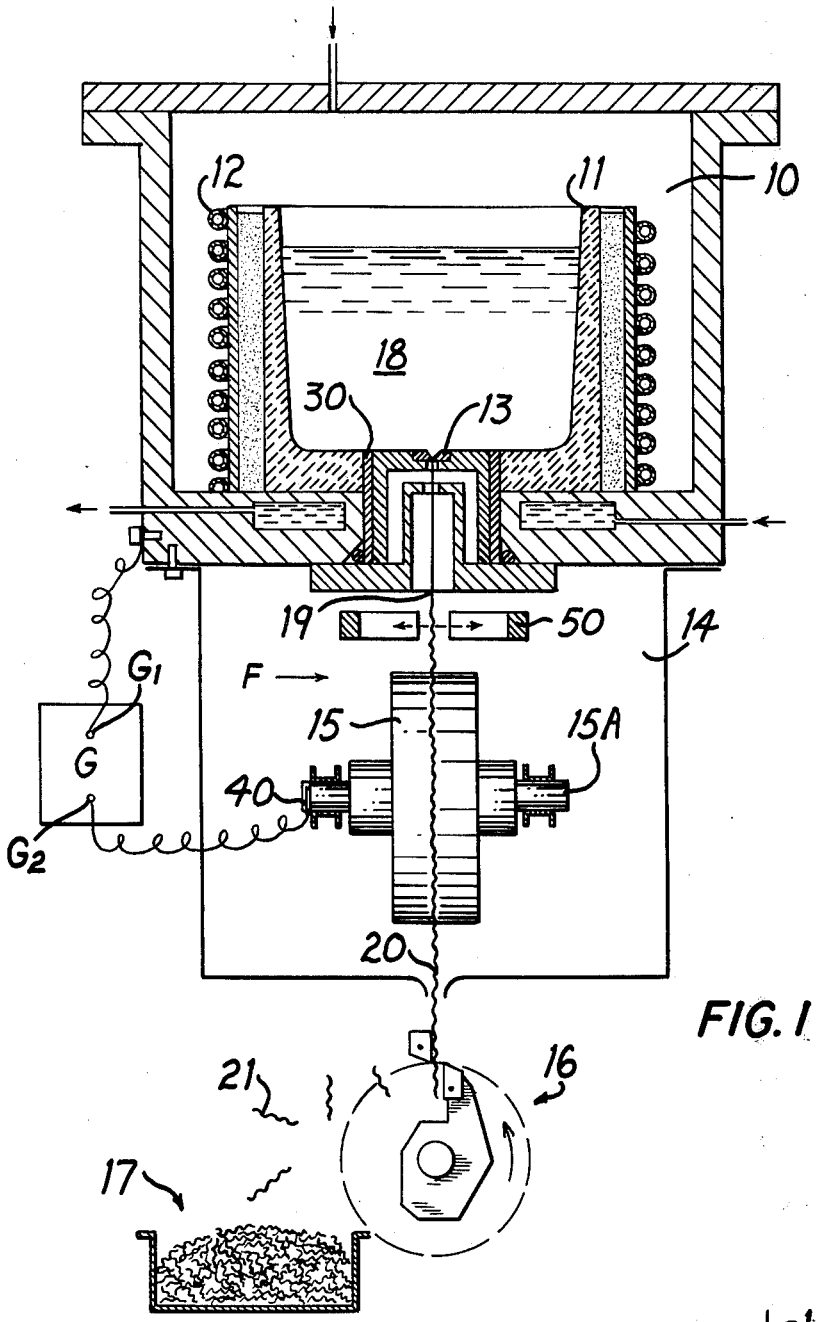
FIGS. 1 and 1A show the essential elements of an installation usable in accordance with the invention, a reciprocating movement being imparted to the jet relative to the cylinder, FIG. 1A being a view through a part of the installation along the arrow F in FIG. 1.

FIG. 1 shows the essential elements of an installation intended to manufacture steel wires of small diameter by the process described in U.S. Pat. No. 3,861,452.

Such an installation comprises a pressurizing enclosure 10, a crucible 11, a heating means 12, a die 13, a cooling chamber 14 containing a cooling medium, a rotatable cylinder 15, shears 16, and a receiving installation 17. The enclosure 10 is fed with a neutral gas at a pressure suitable to project the steel 18 through the die 13. The steel 18 is kept liquid in the crucible 11 by the heating means 12. On the one hand, the liquid jet 19, when it penetrates into the cooling medium upon emerging from the die 13, is imparted a reciprocating movement parallel to the axis of rotation of the axle 15A of the cylinder 15, which cylinder consists of a heat-conductive material. On the other hand, the cylinder 15, which is contained in the cooling chamber 14, is imparted a peripheral speed which is preferably slightly greater than the speed of projection of the liquid jet 19. This jet 19, which is of nearly circular cross-section and effects undulations upon its arrival on the cylinder 15, solidifies in the form of a flattened ribbon 20 undulated transversely to the longitudinal axis of the jet 19 and parallel to the largest dimension of the flattened cross-section of the jet 19. Shears 16 then cut the ribbon 20 to the desired length in order to produce filiform reinforcement elements 21 which accumulate in the receiving installation 17.

The reciprocating movement of the jet 19 may be of constant period or random. This movement may be brought about in various ways.

A first method consists, on the one hand, in placing the liquid steel 18 in contact with the pole $G_1$ of a variable AC generator G. This can be done preferably by means of a metal sealing gasket 30, such as described in U.S. Pat. No. 3,896,870. This gasket 30 is arranged between the die 13 and the pressurizing enclosure 10 and is in contact with the liquid steel 18. On the other hand, the other pole $G_2$ of the generator G is connected with the cylinder 15 by means, for example, of the brush 40, the axle 15A of this cylinder 15 being in electric contact with the shell of the cylinder 15, which itself is a conductor of electricity.

In the path of the jet 19 there is arranged an electromagnet 50 which produces a constant magnetic field. This magnetic field induces a variable alternating force on the jet 19 traversed by the alternating current given off by the generator G.

However, on the other hand, one can also replace the alternating generator G by a source of direct current and feed the electromagnet with a variable alternating current generator so as to produce a variable magnetic field.

Another solution consists in passing a continuous current through the jet 19 and passing said jet 19 through an electrostatic field produced by a cylindrical electrode surrounding the jet.

Figure 2:
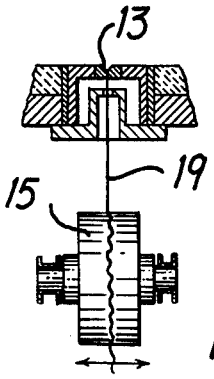
FIG. 2 shows, on a smaller scale, the variant in which a reciprocating movement is imparted to the cylinder relative to the jet.
Figure 1A:
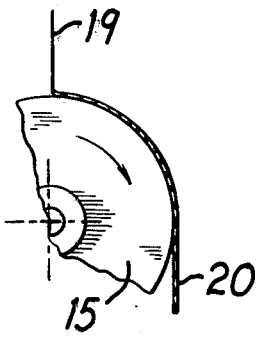

FIG. 2 shows the linear jet 19 coming from the die 13 and arriving on the cylinder 15 which is imparted a reciprocating movement indicated by the double-ended arrow.

Figure 3:
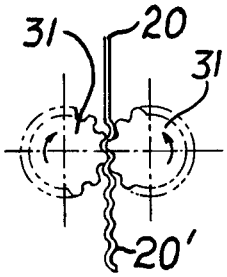
FIG. 3 shows the passage between two grooved rollers of an undulated ribbon to which it is desired to impart an undulation perpendicular to that which it already has.

FIG. 3 shows how the undulated ribbon 20, which has been produced in the manner described above, is engaged between two grooved rollers 31 in order to be undulated in a direction perpendicular to the preceding undulations, whereupon the ribbon 20' is cut into pieces by shears, such as the shears 16 indicated schematically in FIG. 1.

Using a steel having a content of 0.7% carbon, 3.5% silicon, 0.1% manganese and 0.8% chromium, projected at a speed of 2 m/sec. at a distance of 40 mm from the die onto a copper cylinder of a dimater of 0.3 m turning at a speed of 160 rpm, there have been obtained undulated ribbons of a length of 30 mm, a thickness of 0.07 mm and a width of 0.8 mm, undulated in the direction of their width with an amplitude of 1.5 mm and a pitch of 6.3 mm. The jet was traversed by a current of 1.8 volts, 8 amperes and 400 cycles. The induction of the constant magnetic field acting on the jet was equal to 1.5 $Wb/m^2$. The face of the ribbon formed in contact with the cylinder is smooth and flat, while the opposite face is slightly rough and convex. Annealed at 380° C., the ribbons had an ultimate strength of 280 $kg/mm^2$ with an elongation of 5%.

What is claimed is:

1. Process for the manufacture of filiform reinforcement elements of steel in the form of ribbons by projecting a jet of liquid steel onto a cylinder rotating in a cooling medium, characterized by imparting a relative reciprocating movement parallel to the axis of rotation of the cylinder between the jet of liquid steel and the cylinder in order to undulate the ribbon in the direction parallel to the axis of rotation of the cylinder.

2. Process according to claim 1, characterized by imparting a reciprocating movement to the jet parallel to the axis of rotation of the cylinder.

3. Process according to claim 1, characterized by imparting a reciprocating movement to the cylinder parallel to its axis of rotation.

4. Process according to claim 1, characterized by thereafter passing the undulated ribbon between two grooved rollers in order to also undulate the ribbon in the direction perpendicular to the axis of rotation of the cylinder.

5. Process according to claim 2, characterized by traversing the jet with an alternating electric current and passing the jet through a constant magnetic field.

6. Process according to claim 2, characterized by traversing the jet with a constant electric current and passing the jet through a variable magnetic field.

* * * * *